US009406307B2

(12) United States Patent
Rose et al.

(10) Patent No.: US 9,406,307 B2
(45) Date of Patent: Aug. 2, 2016

(54) METHOD AND APPARATUS FOR POLYPHONIC AUDIO SIGNAL PREDICTION IN CODING AND NETWORKING SYSTEMS

(71) Applicant: The Regents of the University of California, Oakland, CA (US)

(72) Inventors: Kenneth Rose, Ojai, CA (US); Tejaswi Nanjundaswamy, Goleta, CA (US)

(73) Assignee: The Regents of the University of California, Oakland, CA (US)

( * ) Notice: Subject to any disclaimer, the term of this patent is extended or adjusted under 35 U.S.C. 154(b) by 327 days.

(21) Appl. No.: 13/970,080

(22) Filed: Aug. 19, 2013

(65) Prior Publication Data

US 2014/0052439 A1 Feb. 20, 2014

Related U.S. Application Data

(60) Provisional application No. 61/684,803, filed on Aug. 19, 2012, provisional application No. 61/691,048, filed on Aug. 20, 2012, provisional application No. 61/865,680, filed on Aug. 14, 2013.

(51) Int. Cl.

| | |
|---|---|
| ***G10L 19/00*** | (2013.01) |
| ***G10L 19/09*** | (2013.01) |
| ***G10L 19/005*** | (2013.01) |
| *G10L 19/02* | (2013.01) |

(52) U.S. Cl.

CPC ..... *G10L 19/09* (2013.01); *G10L 19/005* (2013.01); *G10L 19/02* (2013.01)

(58) Field of Classification Search

CPC ..... G10L 19/08; G10L 19/09
USPC ..... 704/200.1, 219, 500–501
See application file for complete search history.

(56) References Cited

U.S. PATENT DOCUMENTS

| | | | | |
|---|---|---|---|---|
| 5,265,167 | A * | 11/1993 | Akamine | G10L 19/113 704/220 |
| 6,968,309 | B1 * | 11/2005 | Makinen | G10L 19/005 704/206 |
| 2005/0071153 | A1 * | 3/2005 | Tammi | G10L 19/08 704/219 |
| 2006/0047522 | A1 * | 3/2006 | Ojanpera | G10L 19/18 704/503 |

(Continued)

OTHER PUBLICATIONS

Information technology—Coding of audio-visual objects—Part 3: Audio—Subpart 4: General audio coding (GA), ISO/IEC Std. ISO/IEC JTC1/SC29 14 496-3:2005, 2005.

(Continued)

*Primary Examiner* — Shaun Roberts
(74) *Attorney, Agent, or Firm* — Gates & Cooper LLP

(57) ABSTRACT

A method, device, and apparatus provide the ability to predict a portion of a polyphonic audio signal for compression and networking applications. The solution involves a framework of a cascade of long term prediction filters, which by design is tailored to account for all periodic components present in a polyphonic signal. This framework is complemented with a design method to optimize the system parameters. Specialization may include specific techniques for coding and networking scenarios, where the potential of each enhanced prediction is realized to considerably improve the overall system performance for that application. One specific technique provides enhanced inter-frame prediction for the compression of polyphonic audio signals, particularly at low delay. Another specific technique provides improved frame loss concealment capabilities to combat packet loss in audio communications.

17 Claims, 8 Drawing Sheets

(56) References Cited

U.S. PATENT DOCUMENTS

| | | | | |
|---|---|---|---|---|
| 2006/0167682 | A1* | 7/2006 | Lecomte | H04N 7/1675 704/223 |
| 2007/0093206 | A1* | 4/2007 | Desai | H04B 14/04 455/41.2 |
| 2008/0306732 | A1* | 12/2008 | Ghenania | G10L 19/08 704/219 |
| 2008/0306736 | A1* | 12/2008 | Sanyal | G10L 19/0019 704/233 |
| 2010/0286991 | A1* | 11/2010 | Hedelin | G10L 19/035 704/500 |

OTHER PUBLICATIONS

Bluetooth Specification: Advanced Audio Distribution Profile, Bluetooth SIG Std. Bluetooth Audio Video Working Group, 2002.

F. de Bont, M. Groenewegen, and W. Oomen, "A high quality audiocoding system at 128 kb/s," in Proc. 98th AES Convention, Feb. 1995, paper 3937.

E. Allamanche, R. Geiger, J. Herre, and T. Sporer, "MPEG-4 low delay audio coding based on the AAC codec," in Proc. 106th AES Convention, May 1999, paper 4929.

J. Ojanpera, M. Vaananen, and L. Yin, "Long term predictor for transform domain perceptual audio coding," in Proc. 107th AES Convention, Sep. 1999, paper 5036.

T. Nanjundaswamy, V. Melkote, E. Ravelli, and K. Rose, "Perceptual distortion-rate optimization of long term prediction in MPEG AAC," in Proc. 129th AES Convention, Nov. 2010, paper 8288.

B. S. Atal and M. R. Schroeder, "Predictive coding of speech signals," in Proc. Conf. Commun., Processing, Nov. 1967, pp. 360-361.

S. M. Kay, Modern Spectral Estimation. Englewood Cliffs, NJ: Prentice-Hall, 1988.

A. de Cheveign'e, "A mixed speech F0 estimation algorithm," in Proceedings of the 2nd European Conference on Speech Communication and Technology (Eurospeech '91), Sep. 1991.

D. Giacobello, T. van Waterschoot, M. Christensen, S. Jensen, and M. Moonen, "High-order sparse linear predictors for audio processing," in Proc. 18th European Sig. Proc. Conf., Aug. 2010, pp. 234-238.

Information technology—Coding of moving pictures and associated audio for digital storage media at up to about 1.5 Mbit/s—Part 3: Audio, ISO/IEC Std. ISO/IEC JTC1/SC29 11 172-3, 1993.

M. Bosi, K. Brandenburg, S. Quackenbush, L. Fielder, K. Akagiri, H. Fuchs, M. Dietz, J. Herre, G. Davidson, and Y. Oikawa, "ISO/IEC MPEG-2 advanced audio coding," J. Audio Eng. Soc., vol. 45, No. 10, pp. 789-814, Oct. 1997.

A. Aggarwal, S. L. Regunathan, and K. Rose, "Trellis-based optimization of MPEG-4 advanced audio coding," in Proc. IEEE Workshop on Speech Coding, 2000, pp. 142-144.

A. Aggarwal, "A trellis-based optimal parameter value selection for audio coding," IEEE Trans. Audio, Speech, and Lang. Process., vol. 14, No. 2, pp. 623-633, 2006.

C. Bauer and M. Vinton, "Joint optimization of scale factors and Huffman codebooks for MPEG-4 AAC," in Proc. 6th IEEE Workshop. Multimedia Sig. Proc., Sep. 2004.

R. P. Ramachandran and P. Kabal, "Pitch prediction filters in speech coding," IEEE Trans. Acoust., Speech, Signal Process., vol. 37, No. 4, pp. 467-477, 1989.

R. Pettigrew and V. Cuperman, "Backward pitch prediction for lowdelay speech coding," in Conf. Rec., IEEE Global Telecommunications Conf., Nov. 1989, pp. 34.3.1-34.3.6.

H. Chen, W. Wong, and C. Ko, "Comparison of pitch prediction and adaptation algorithms in forward and backward adaptive CELP systems," in Communications, Speech and Vision, IEE Proceedings I, vol. 140, No. 4, 1993, pp. 240-245.

M. Yong and A. Gersho, "Efficient encoding of the long-term predictor in vector excitation coders," Advances in Speech Coding, pp. 329-338, Dordrecht, Holland: Kluwer, 1991.

S. McClellan, J. Gibson, and B. Rutherford, "Efficient pitch filter encoding for variable rate speech processing," IEEE Trans. Speech Audio Process., vol. 7, No. 1, pp. 18-29, 1999.

J Marques, I. Trancoso, J. Tribolet, and L. Almeida, "Improved pitch prediction with fractional delays in CELP coding," in Proc. IEEE Intl. Conf. Acoustics, Speech, and Sig. Proc., 1990, pp. 665-668.

D. Veeneman and B. Mazor, "Efficient multi-tap pitch prediction for stochastic coding," Kluwer international series in engineering and computer science, pp. 225-225, 1993.

P. Kroon and K. Swaminathan, "A high-quality multirate real-time CELP coder," IEEE J. Sel. Areas Commun., vol. 10, No. 5, pp. 850-857, 1992.

J. Chen, "Toll-quality 16 kb/s CELP speech coding with very low complexity," in Proc. IEEE Intl. Conf. Acoustics, Speech, and Sig. Proc., 1995, pp. 9-12.

W. Kleijn and K. Paliwal, Speech coding and synthesis. Elsevier Science Inc., 1995, pp. 95-102.

Method of Subjective Assessment of Intermediate Quality Level of Coding Systems, ITU Std. ITU-R Recommendation, BS 1534-1, 2001.

R. P. Ramachandran and P. Kabal, "Stability and performance analysis of pitch filters in speech coders," IEEE Trans. Acoust., Speech, Signal Process., vol. 35, No. 7, pp. 937-946, 1987.

A. Said, "Introduction to arithmetic coding-theory and practice," Hewlett Packard Laboratories Report, 2004.

C. Perkins, O. Hodson, and V. Hardman, "A survey of packet loss recovery techniques for streaming audio," IEEE Network, vol. 12, No. 5, pp. 40-48, 1998.

S.J. Godsill and P.J.W. Rayner, Digital audio restoration: a statistical model based approach, Springer verlag, 1998.

J. Herre and E. Eberlein, "Evaluation of concealment techniques for compressed digital audio," in Proc. 94th Conv. Aud. Eng. Soc, Feb. 1993, Paper 3460.

R. Sperschneider and P. Lauber, "Error concealment for compressed digital audio," in Proc. 111th Conv. Aud. Eng. Soc, Sep. 2001, Paper 5460.

S.U. Ryu and K. Rose, "An mdct domain frame-loss concealment technique for mpeg advanced audio coding," in IEEE ICASSP, 2007, pp. I-273-I-276.

J. Nocedal, "Updating quasi-newton matrices with limited storage," Mathematics of computation, vol. 35, No. 151, pp. 773-782,1980.

J. Nocedal and S.J. Wright, Numerical optimization, Springer verlag, 1999.

* cited by examiner

METHOD AND APPARATUS FOR POLYPHONIC AUDIO SIGNAL PREDICTION IN CODING AND NETWORKING SYSTEMS

CROSS-REFERENCE TO RELATED APPLICATIONS

This application claims the benefit under 35 U.S.C. Section 119(e) of the following commonly-assigned U.S. provisional patent application(s), which is/are incorporated by reference herein:

Provisional Application Ser. No. 61/684,803, filed on Aug. 19, 2012, by Kenneth Rose and Tejaswi Nanjundaswamy, entitled "Method and Apparatus for Polyphonic Audio Signal Prediction in Coding and Networking Systems,";

Provisional Application Ser. No. 61/691,048, filed on Aug. 20, 2012, by Kenneth Rose and Tejaswi Nanjundaswamy, entitled "Method and Apparatus for Polyphonic Audio Signal Prediction in Coding and Networking Systems,"; and Provisional Application Ser. No. 61/865,680, filed on Aug. 14, 2013, by Tejaswi Nanjundaswamy and Kenneth Rose, entitled "Cascaded Long Term Prediction for Efficient Compression of Polyphonic Audio Signals,".

STATEMENT REGARDING FEDERALLY SPONSORED RESEARCH AND DEVELOPMENT

This invention was made with Government support under Grant No. CCF-0917230 awarded by the NSF/A Resource-Scalable Unifying Framework for Aural Signal Coding. The Government has certain rights in this invention.

BACKGROUND OF THE INVENTION

1. Field of the Invention

This invention relates to signal prediction, and more particularly, to a long term prediction method and apparatus for polyphonic audio signal prediction in coding and network systems.

2. Description of the Related Art (Note: This application references a number of different publications as indicated throughout the specification by one or more reference numbers within brackets, e.g., [x]. A list of these different publications ordered according to these reference numbers can be found below in the section entitled "References." Each of these publications is incorporated by reference herein.)

Virtually all audio signals consist of naturally occurring sounds that are periodic in nature. Efficient prediction of these periodic components is critical to numerous important applications such as audio compression, audio networking, audio delivery to mobile devices, and audio source separation. While the prediction of monophonic audio (which consists of a single periodic component) is a largely solved problem, where the solution employs a long-term prediction (LTP) filter, no truly efficient prediction technique is known for the overwhelmingly more important case of polyphonic audio signals that contain a mixture of multiple periodic components. Specifically, most audio content is polyphonic in nature, including virtually all music signals.

In addition, a wide range of applications such as multimedia streaming, online radio, and high-definition teleconferencing are enabled by transmission of audio over networks. However, a rapid increase in the "always-connected" user base has exacerbated the problem of unreliable channel conditions, prominently in the ubiquitous wireless and mobile communication channels, leading to intermittent loss of data.

An effective frame loss concealment (FLC) technique plays an important role in gracefully handling this loss of data. Despite extensive industrial efforts, state-of-the-art FLC techniques do not offer efficient solutions for the important case of polyphonic audio signals, including virtually all music signals, where the signal comprises a mixture of multiple periodic components.

To better understand the problems of the prior art, some background information regarding prior art compression technology and networking (frame loss concealment) may be useful.

Compression Background

As described above, a wide range of multimedia applications such as handheld playback devices, internet radio and television, online media streaming, gaming, and high fidelity teleconferencing heavily rely on advances in audio compression. Their success and proliferation have greatly benefited from current audio coders, including the MPEG (Moving Pictures Experts Group) Advanced Audio Coding (AAC) standard [1], which employ a modified discrete cosine transform (MDCT), whose decorrelating properties eliminate redundancies within a block of data. Still, there is potential for exploiting redundancies across frames, as audio content typically consists of naturally occurring periodic signals, examples of which include voiced parts of speech, music from string and wind instruments, etc. Note that interframe redundancy removal is highly critical in the cases of short frame coders such as the ultra low delay Bluetooth Subband Codec (SBC) [2], [3] and the MPEG AAC in low delay (LD) mode [4]. For an audio signal with only one periodic component (i.e., a monophonic signal), inter-frame decorrelation can be achieved by the long term prediction (LTP) tool, which exploits repetition in the waveform by providing a segment of previously reconstructed samples, scaled appropriately, as prediction for the current frame. The resulting low energy residue is encoded at a reduced rate. The past segment position (called "lag") and the scaling/gain factor are either sent as side information or are backward adaptive, i.e., estimated from past reconstructed content at both encoder and decoder. In MPEG AAC, the optional LTP tool [5], transmits the lag and gain factor as side information, along with flags to selectively enable prediction in a subset of frequency bands. Typically, time domain waveform matching techniques that use a correlation measure are employed to find the lag, and other parameters so as to minimize the mean squared prediction error. Recently, avenues for improved parameter selection for the LTP tool in MPEG AAC have been explored [6], and a perceptual optimization technique may be utilized, which jointly optimizes LTP parameters along with quantization and coding parameters, while explicitly accounting for the perceptual distortion and rate tradeoffs.

The existing LTP is well suited for signals containing a single periodic component, but this is not the case for general audio which often contains a mixture of multiple periodic signals. Typically, audio belongs to the class of polyphonic signals which includes as common examples, vocals with background music, orchestra, and chorus. Note that a single instrument may also produce multiple periodic components, as is the case for the piano or the guitar. In principle, the mixture is itself periodic albeit with overall period equaling the least common multiple (LCM) of all individual component periods, but the signal rarely remains stationary over such extended duration. Consequently, LTP resorts to a compromise by predicting from a recent segment that represents some tradeoff between incompatible component periods, with corresponding negative impact on its performance. The performance degradation of the LTP tool in MPEG AAC has been previously observed, where even when perceptually optimized, it did not yield noticeable performance improvement for polyphonic signals [6]. Nevertheless, if exploited properly, the redundancies implicit in the periodic components of the signal may offer a significant potential for compression gains.

Bluetooth SBC Background

The Bluetooth Sub-band Codec (SBC) [2], [3] employs a simple ultra-low-delay compression technique for use in short range wireless audio transmission. The SBC encoder blocks the audio signal into frames of BK samples, where samples of frame n are denoted x[m], $nBK \le m < (n+1)BK$. The frame is analyzed into $B \in \{4 \text{ or } 8\}$ subbands with $K \in \{4, 8, 12 \text{ or } 16\}$ samples in each subband, denoted $c_n[b,k]$, $0 \le b < B$, $0 \le k < K$. The analysis filter bank is similar to the one in MPEG Layer 1-3 [13], but has a filter order of 10B, with history requirement of 9B samples, while analyzing B samples of input at a time. The block of K samples in each sub-band is then quantized adaptively to minimize the quantization MSE (mean square error). The effective scalefactor $s_n[b]$; $0 \le b < B$ for each subband is sent to the decoder as side information. Note that the FIR (finite impulse response) filter used in the analysis filter bank introduces a delay of (9B+1)/2 samples. The decoder receives the quantization step sizes and the quantized data in the bitstream. The subband data is dequantized and input to the synthesis filter bank (similar to the one used in MPEG Layer 1-3) to generate the reconstructed output signal. The analysis and synthesis filter banks together introduce a delay of (9B+1) samples.

MPEG AAC

MPEG AAC is a transform based perceptual audio coder. The AAC encoder segments the audio signal into 50% overlapped frames of 2K samples each (K=512 in the LD [low delay] mode), with frame n composed of the samples x[m], $nK \le m < (n+2)K$. These samples are transformed via MDCT to produce K transform coefficients, denoted by $c_n[k]$, $0 \le k < K$. The transform coefficients are grouped into L frequency bands (known as scale-factor bands or SFBs) such that all the coefficients in a band are quantized using the same scaled version of the generic AAC quantizer. For each SFB l, the scaling factor (SF), denoted by $s_n[l]$, controls the quantization noise level. The quantized coefficients (denoted by $\hat{c}_n[k]$) in an SFB are then Huffman coded using one of the finite set of Huffman codebooks (HCBs) specified by the standard, and the choice is indicated by the HCB index $h_n[l]$. One may denote by $p_n=(s_n,h_n)$ the encoding parameters for frame n, with $s_n=\{s_n[0], \ldots, s_n[L-1]\}$ and $h_n=\{h_n[0], \ldots, h_n[L-1]\}$. Given a target rate for the frame, the SFs and HCBs are selected to minimize the perceptual distortion. The distortion is based on the noise-to-mask ratio (NMR), calculated for each SFB as the ratio of quantization noise energy in the band to a noise masking threshold provided by a psychoacoustic model $$d_{(n,l)}(s_n[l]) = \frac{\sum_{k \in SFB\, l} (c_n[k] - \hat{c}_n[k])^2}{\mu_n[l]} \tag{1}$$

where $\mu_n[l]$ is the masking threshold in SFB l of frame n. The overall per-frame distortion $D_n(p_n)$ may then be calculated by averaging or maximizing over SFBs. For example, this distortion may be defined as the maximum NMR (MNMR)

$$D_n(p_n) = \max_{0 \le l < L} d_{(n,l)}(s_n[l]) \tag{2}$$

Since the standard only dictates the bitstream syntax and the decoder part of the codec, numerous techniques to optimize the encoder parameters have been proposed (e.g., [1], [14]-[17]). Specifically, the MPEG AAC verification model (publicly available as informative part of the MPEG standard) optimizes the encoder parameters via a low-complexity technique known as the two-loop search (TLS) [1], [14]. An inner loop finds the best SF for each SFB to satisfy a target distortion criterion for the band. The outer loop then determines the set of HCBs that minimize the number of bits needed to encode the quantized coefficients and the side information. If the resulting bit rate exceeds the rate constraint for the frame, the target distortion in the inner loop is increased and the two loops are repeated. The bit-stream consists of quantized data and the side information, which includes, per SFB, one SF (that is differentially encoded across SFBs), and one HCB index (which is runlength encoded across SFBs). For simplicity, except for the LTP tool, optional tools available in the MPEG framework may not be considered (e.g., the bit reservoir, window shape switching, temporal noise shaping, etc.).

Long Term Prediction

Transform and subband coders efficiently exploit correlations within a frame, but the frame size is often limited by the delay constraints of an application. This motivates interframe prediction, especially for low delay coders, to remove redundancies across frames, which otherwise would have been captured by a long block transform. One technique for exploiting long term correlations has been well known since the advent of predictive coding for speech [9], and is called pitch prediction, which is used in the quasi-periodic voiced segments of speech. The pitch predictor is also referred to as long term prediction filter, pitch filter, or adaptive codebook for a code-excited linear predictor. The generic structure of such a filter is given as $$H(z) = 1 - \sum_{k=0}^{T-1} \beta_k z^{-N+k} \tag{3}$$

where N corresponds to the pitch period, T is the number of filter taps, and $\beta_k$ are the filter coefficients. This filter and its role in efficient coding of voiced segments in speech, have been extensively studied. A thorough review and analysis of various structures for pitch prediction filters is available in [18]. Backward adaptive parameter estimation was proposed in [19] for low-delay speech coding, but forward adaption was found to be advantageous in [20]. Different techniques to efficiently transmit the filter information were proposed in [21] and [22]. The idea of using more than one filter taps (i.e., T>1 in equation (3)) was originally conceived to approximate fractional delay [23], but has been found to have broader impact in [24]. Techniques for reducing complexity of parameter estimation have been studied in [25] and [26]. For a review of speech coding work in modeling periodicity, see [27].

In addition to the above, long term prediction is prevalent in speech coding techniques, and has also been proposed as an optional tool for the audio coding standard of MPEG AAC. Details regarding long term prediction tools in the MPEG AAC standard are described in further detail in the provisional applications cross referenced above and incorporated by reference herein.

Networking (Frame Loss Concealment Background)

As described above, audio transmission over networks enables a wide range of applications such as multimedia streaming, online radio and high-definition teleconferencing. These applications are often plagued by the problem of unreliable networking conditions, which leads to intermittent loss of data, where a portion of the audio signal, corresponding to one or more frames, is lost. FLC forms a crucial tool amongst the various strategies used to mitigate this issue. The FLC objective is to exploit all available information to approximate the lost frame while maintaining smooth transition with neighboring frames.

Various techniques have been proposed for FLC, amongst which the simple techniques of replacing the lost frame with silence or the previous frame, result in poor quality [31]. Advanced techniques are usually based on source modeling and were inspired from solutions to the equivalent problem of click removal in audio restoration [32]. For example, speech signals have one periodic component, and FLC techniques based on pitch waveform repetition are widely used. But these techniques fail for most audio signals which are polyphonic in nature, because they contain a mixture of periodic components. In principle, the mixture is itself periodic with period equaling the least common multiple (LCM) of its individual periods, but the signal rarely remains stationary over this extended duration, rendering the pitch repetition techniques ineffective. To handle signals with multiple periodic components, various frequency domain techniques have been proposed. FLC techniques based on sub-band domain prediction [33, 34] handle multiple tonal components in each sub-band via a higher order linear predictor. Such an approach does not utilize samples from future frames and is effectively an extrapolation technique with the shortcoming that it disregards smooth transition into future frames. An alternative approach performs FLC in the modified discrete cosine transform (MDCT) domain, and accounts for future frames [35]. This technique isolates tonal components in MDCT domain and interpolates the relevant missing MDCT coefficients of the lost frame using available past and future frames. Its performance gains, while substantial, were limited in the presence of multiple periodic components in polyphonic signals, whenever isolating individual tonal components was compromised by the frequency resolution of MDCT. This problem is notably pronounced in low delay coders which use low resolution MDCT.

Based on the shortcomings of existing FLC techniques, it is desirable to efficiently conceal lost frames of polyphonic signals. Prior art methods have failed to provide such a capability. In other words, in a wireless environment, or other environments where signal strength and data links are often difficult to maintain, a simple adaptation of a prediction tool is not sufficient to process and accurately predict typical signals encountered in common applications such as cellular telephony, local wireless connections such as Bluetooth or Wi-Fi, or other dynamic signal environments. It can be seen, then, that there is a need in the art for prediction tools that are capable of performing in such environments. It can also be seen, then, that such prediction tools should preferably be useful in real-time such that data links can be maintained in such environments.

SUMMARY OF THE INVENTION

Embodiments of the invention overcome the shortcomings of the prior art by exploiting redundancies (implicit in the periodic components of a polyphonic signal) by cascading LTP filters, each corresponding to individual periodic components of the signal, to form an overall "cascaded long term prediction" (CLTP) filter. Such a construct enables predicting every periodic component in the current frame from the most recent previously reconstructed segment, with which it is maximally correlated. Moreover, as a result, the overall filter requires only a limited history.

It is obvious that, for compression applications, CLTP's efficacy is critically dependent on an effective parameter estimation technique, and even more so for coders such as MPEG AAC, where perceptual distortion criteria must be taken into account. Embodiments of the invention provide, as a basic platform, prediction parameter optimization that targets mean squared error (MSE). The platform then may be adapted to specific coders and their distortion criteria (e.g., the perceptual distortion criteria of MPEG AAC). To estimate such prediction parameters at acceptable complexity, while approaching optimality, a "divide and conquer" recursive technique is utilized. More specifically, optimal parameters of an individual filter in the cascade are found, while fixing all other filter parameters. This process is then iterated for all filters in a loop, until convergence or until a desired level of performance is met, to obtain the parameters of all LTP filters in the cascade. For the Bluetooth SBC, that uses a simple quantization MSE distortion, this technique may be employed in a backward adaptive way, thereby minimizing the side information rate, as the decoder can mimic this procedure. Backward adaptive estimation assumes local stationarity of the signal. For the MPEG AAC, the parameters may be estimated in two stages, where the backward adaptive MSE minimizing method is first employed to estimate a large subset of prediction parameters, which includes lags and preliminary gains of the CLTP filter, and per band prediction activation flags. In the next stage, the gains are further refined for the current frame, with respect to the perceptual criteria, and only refinement parameters are sent as side information.

Low decoder complexity and moderate decoder complexity variants for the MPEG AAC may also be utilized, wherein all the parameters are sent as side information to the decoder, or most of the parameters are sent as side information to the decoder, respectively. Even in these variants, parameter estimation may be done in two stages, where one may first estimate a large subset of parameters to minimize MSE, and in the next stage, the parameters are fine tuned to take perceptual distortion criteria into account. Note that the prediction side information is encoded while taking into account the inter-frame dependency of parameters. Performance gains of this embodiment of the invention, assessed via objective and subjective evaluations for all the settings, demonstrates its effectiveness on a wide range of polyphonic signals.

With respect to fame loss concealment, the shortcomings of existing FLC techniques may be overcome using the cascaded long term prediction (CLTP) filter described above. A preliminary set of parameters for these filters may be estimated from past reconstructed samples via a recursive divide and conquer technique. In this recursion, parameters of one filter in the cascade are estimated while parameters of the others are fixed, and the process is iterated until convergence or until a desired level of performance is met. Amongst these preliminary parameters, the pitch periods of each component may be assumed to be stationary during the lost frame, while the filter coefficients are enhanced via a multiplicative factor (or gain) to minimize the squared prediction error across future reconstructed samples. The predicted samples required for this minimization may be generated via a 'looped' process, wherein given all the parameters, the filter is operated in the synthesis mode in a loop, with predictor output acting as input to the filter as well. The minimization may be achieved via a gradient descent optimization, for example using a quasi-Newton method called limited-memory Broyden-Fletcher-Goldfarb-Shanno (L-BFGS) method along with backtracking line search for step size. Similarly, another set of multiplicative factors may be generated for predicting the lost frame in the reverse direction from future samples. Finally the two sets of predicted samples may be overlap-added with a triangular window to reconstruct the lost frame. Such a scheme may be incorporated within an MPEG AAC low delay (LD) mode decoder, with band-wise energy adjustment when there is a large deviation from the geometric mean of energies in the bands of adjacent frames. Subjective and objective evaluation results for a wide range of polyphonic signals substantiate the effectiveness of the proposed technique.

In view of the above and as described herein, embodiments of the present invention disclose methods and apparatuses for prediction of a portion of audio signals. Recursive estimation techniques, which optimize parameters of individual filters, which are used in a cascade of filters, while maintaining parameters in other filters, and this process is then iterated for each filter in a loop until convergence is realized. Embodiments of the present invention can also be integrated into several applications, such as Bluetooth or other wireless devices, to provide prediction tools to such systems.

BRIEF DESCRIPTION OF THE DRAWINGS

Referring now to the drawings in which like reference numbers represent corresponding parts throughout.

DETAILED DESCRIPTION OF THE INVENTION

Figure 1:
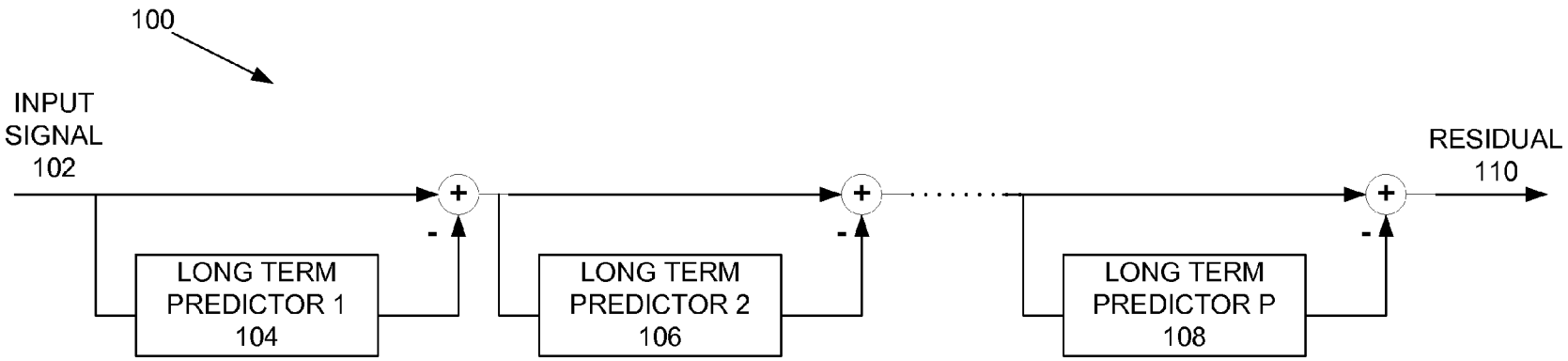
FIG. 1 illustrates a cascaded analysis filter approach in accordance with one or more embodiments of the present invention.

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Overview

Most audio signals contain naturally occurring periodic sounds and exploiting redundancy due to these periodic components is critical to numerous important applications such as audio compression, audio networking, audio delivery to mobile devices, and audio source separation. For monophonic audio (which consists of a single periodic component) the Long Term Prediction (LTP) tool has been used successfully. This tool capitalizes on the periodic component of the waveform by selecting a past segment as the basis for prediction of the current frame. However, as described above, most audio signals are polyphonic in nature, consisting of a mixture of periodic signals. This renders the Long Term Prediction (LTP) results sub-optimal, as the mixture period equals the least common multiple of its individual component periods, which typically extends far beyond the duration over which the signal is stationary.

Instead of seeking a past segment that represents a "compromise" for incompatible component periods, embodiments of the present invention comprises a more complex filter that caters to the individual signal components. More specifically, one may note that redundancies implicit in the periodic components of a polyphonic signal may offer a significant potential for compression gains and concealment quality improvement. Embodiments of the present invention exploit such redundancies by cascading LTP filters, each corresponding to individual periodic components of the signal, to form what is referred to as a "cascaded long term prediction" (CLTP) filter. In other words, every periodic component of the signal (in the current frame) may be predicted from its immediate history (i.e., the most recent previously reconstructed segment with which it is maximally correlated) by cascading LTP filters, each corresponding to an individual periodic component.

As efficacy of such prediction is dependent on effective parameter estimation, prediction parameter optimization may target mean squared error (MSE) as a basic platform. Such a basic platform may then be adapted to specific coders and their distortion criteria (e.g., the perceptual distortion criteria of MPEG AAC). To estimate such prediction parameters at acceptable complexity (while approaching optimality), embodiments of the invention employ a recursive "divide and conquer" technique to estimate the parameters of all the LTP filters. More specifically, the optimal parameters of an individual filter in the cascade are found, while fixing all other filter parameters. This process is then iterated for all filters in a loop, until convergence or until a desired level of performance is met, to obtain the parameters of all LTP filters in the cascade. In compression systems, such a technique may also be employed in a backward adaptive way (e.g., in systems that use a simple quantization MSE distortion), to minimize the side information rate, as a decoder can mimic this procedure. In alternative compression systems (e.g., MPEG AAC), parameters may be estimated in two stages, where one first employs the backward adaptive MSE minimizing method to estimate a large subset of prediction parameters (which includes lags and preliminary gains of the CLTP filter, and per band prediction activation flags). In the next stage, the gains are further refined for the current frame, with respect to the perceptual criteria, and only refinement parameters are sent as side information. Low decoder complexity and moderate decoder complexity variants for such compression systems (e.g., for the MPEG AAC) may also be employed, wherein all the parameters are sent as side information to the decoder, or most of the parameters are sent as side information to the decoder, respectively. In such variants, parameter estimation is done in two stages where one first estimates a large subset of parameters to minimize MSE and in the next stage, the parameters are fine tuned to take perceptual distortion criteria into account. For frame loss concealment, a four stage process may be employed, wherein a preliminary set of parameters for CLTP are estimated from past reconstructed samples via the recursive technique. The parameters are then further enhanced via multiplicative factors to minimize the squared prediction error across future reconstructed samples. Another set of parameters are estimated for predicting the lost frame in the reverse direction from future samples. Finally the two sets of predicted samples are overlap-added with a triangular window to reconstruct the lost frame.

Such embodiments have been evaluated after incorporation within existing systems, such as within the Bluetooth Sub-band Codec and MPEG AAC low delay (LD) mode coder. Results achieved through use of such embodiments show considerable gains achieved on a variety of polyphonic signals, thereby indicating the effectiveness of such embodiments.

Detailed Technical Description

A simple periodic signal with pitch period N can be described as follows:

$$x[n]=x[n-N] \tag{1}$$

However, naturally occurring periodic signals are not perfectly stationary and have non-integral pitch periods. Thus, a more accurate description is $$x[n]=\alpha x[n-N]+\beta x[n-N+1] \tag{2}$$

where $\alpha$ and $\beta$ capture amplitude changes and approximate the non-integral pitch period via a linear interpolation. A mixture of such periodic signals along with noise models a polyphonic audio signal, as described below $$x[n] = \sum_{i=0}^{P-1} x_i[n] + w[n] \tag{3}$$

where P is the number of periodic components, w[n] is a noise sequence, and $x_i[m]$ are periodic signals satisfying $x_i[n]=\alpha_i x_i[n-N_i]+\beta_i x_i[n-N_i+1]$.

Embodiments of the present invention comprise a filter that minimizes the prediction error energy. When all periodic components are filtered out, the prediction error is dependent only on the noise sequence (also known as w[n]) or the change in the signal during the time period (also referred to as the innovation). The related art of LTP typically attempts to resolve this issue by using a compromise solution, which minimizes the mean squared prediction error while using the history available for prediction of a future signal. Due to non-stationary nature of the signal over long durations, using the effective period of the polyphonic signal, which is the Least Common Multiple (LCM) of the periods of its individual components, as lag of the LTP is highly sub-optimal. Further, if the LCM is beyond the history available for prediction, the related art approach defaults to attempting to find an estimate despite incompatible periods for the signal components, which adds error to the prediction using such an approach.

Embodiments of the present invention minimize or eliminate these deficiencies in the related art by cascading filters such that all of the periodic components are filtered out or canceled, leaving a minimum energy prediction error dependent only on the noise sequence. Such a cascaded long term prediction (CLTP) analysis filter for polyphonic signals described in equation (3) above is given below $$H(z) = \prod_{i=0}^{P-1} (1 - \alpha_i z^{-N_i} - \beta_i z^{-N_i+1}) \tag{4}$$

FIG. 1 illustrates the cascaded long term prediction (CLTP) analysis filter in accordance with one or more embodiments of the invention. System 100 comprises filters 104, 106 and 108 put together to form the analysis filter H(z) given in equation (4). Although three filters 104-108 are shown, a larger or smaller number of filters can be used without departing from the scope of the present invention. As illustrated input signal 102 is processed through filters 104-108 that are cascaded. Each LTP filter 104-108 in this structure serves to filter (i.e., remove) a portion of input signal 102 leaving a residual signal 110. Signal 102 is typically a polyphonic audio signal, but can be a single periodic signal, a signal in a different frequency band, or any signal without departing from the scope of the present invention.

Figure 2:
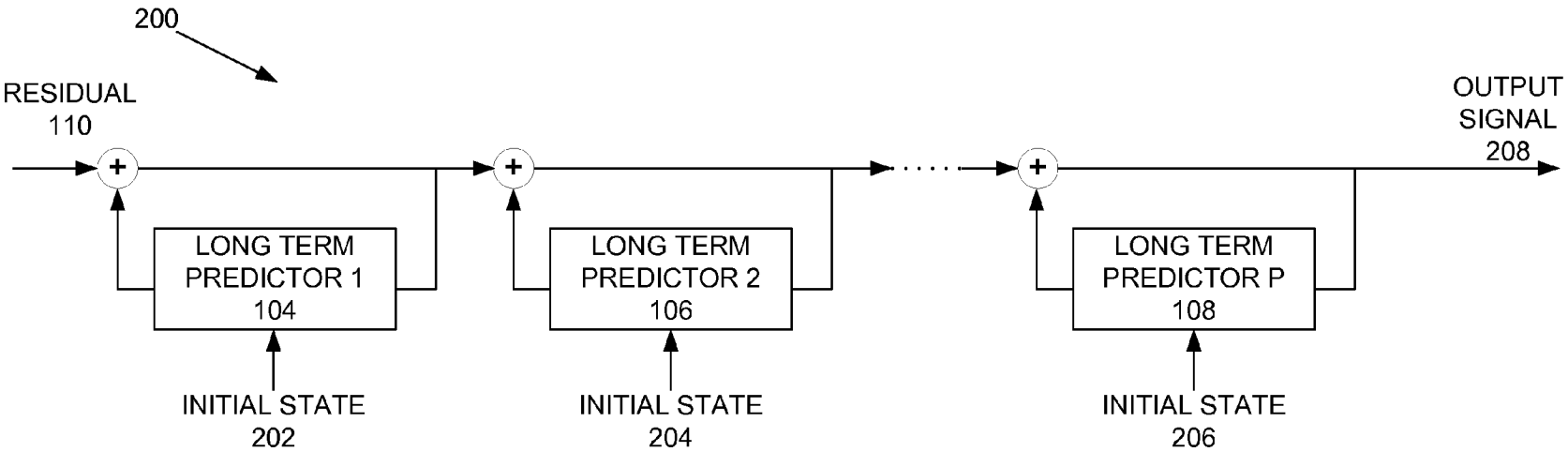
FIG. 2 illustrates a cascaded synthesis filter approach in accordance with one or more embodiments of the present invention.

FIG. 2 illustrates the cascaded long term prediction (CLTP) synthesis filter in accordance with one or more embodiments of the invention. System 200 comprises filters 104, 106 and 108 put together to form the synthesis filter, 1/H(z), where H(z) is given in equation (4). Although three filters 104-108 are shown, a larger or smaller number of filters can be used without departing from the scope of the present invention. As illustrated the residual signal 110 is processed through LTP filters 104-108 (with initial states 202-206) that are cascaded. Each LTP filter 104-108 in this structure serves to reconstruct a portion of the signal to produce the output signal 208.

Parameter Estimation

The parameters for each filter in the cascade can be estimated in several ways within the scope of the present invention. Parameter estimation specifically adapted for the application, for example the perceptual distortion criteria of an audio coder or accounting for all available information during frame loss concealment, is crucial to the effectiveness of this technique with real polyphonic signals. However, as a starting point to solve this problem, one may first derive a minimum mean squared prediction error technique to optimize the CLTP parameter set:

$$N_i, \alpha_i, \beta_i \forall i \in \{0, \ldots, P-1\}$$

A straightforward purely combinatorial approach would be to evaluate all combinations from a predefined set of values to find the one that minimizes the prediction error. This can be done by first fixing the range of pitch periods to Q possibilities, then finding the best $\alpha_i, \beta_i$ for each of the $Q^P$ period combination and finally selecting the period combination that minimizes the mean squared prediction error. Clearly, the complexity of this approach grows exponentially with the number of periodic components. For the modest choice of Q=100 and P=5, there are $Q^P=10^{10}$ combinations to be re-evaluated every time the parameters undergo updates, resulting in prohibitive computational complexity. Thus, embodiments of the invention propose a "divide and conquer" recursive estimation technique. Other approaches, such as estimation exploiting application-specific information such as expected signal frequencies and bandwidth, or other parameter estimations can be employed within the scope of the present invention.

One or more embodiments perform estimation by fixing the number of periodic components that are present in the incoming signal, and estimating the parameters for one filter based on that number while maintaining unchanged the parameters of other filters. Estimating parameters for a single prediction filter is a prediction problem involving correlation of current samples with past signal samples. For a given number of periodic components, P, to estimate the jth filter parameters, $N_j,\alpha_i,\beta_i$, all other filters are fixed and the partial filter is defined:

$$\overline{H}_j(z) = \prod_{\forall i, i \neq j} (1 - \alpha_i z^{-N_i} - \beta_i z^{-N_i+1})$$

and the corresponding residue $$X_j(z) = X(z)\overline{H}_j(z)$$

The parameters of the jth filter $H_j(z)=1-\alpha_i z^{-N_i}-\beta_i z^{-N_i+1}$ are optimized for the residue $x_j[m]$. This boils down to the classic LTP problem, where for a given N the values $\alpha_{(j,N)},\beta_{(j,N)}$ are given by $$\begin{bmatrix} \alpha_{(j,N)} \\ \beta_{(j,N)} \end{bmatrix} = \begin{bmatrix} r_{(N,N)} & r_{(N-1,N)} \\ r_{(N-1,N)} & r_{(N-1,N-1)} \end{bmatrix}^{-1} \begin{bmatrix} r_{(0,N)} \\ r_{(0,N-1)} \end{bmatrix}$$

where the correlation values $r_{(k,l)}$ are $$r_{(k,l)} = \sum_{m=Y_{start}}^{Y_{end}} x_j[m-k]x_j[m-l]$$

where, $Y_{start}$ and $Y_{end}$ are the limits of summation and depend on the length of the available history and the length of the current frame. Stability of the synthesis filter used in prediction may be ensured by restricting $\alpha_{(j,N)},\beta_{(j,N)}$ solutions to only those that satisfy the sufficient stability criteria of:

$$|\alpha_{(j,N)}|+|\beta_{(j,N)}|\leq 1$$

For details on estimating parameters which satisfy the sufficient stability criteria, please refer to the provisional applications incorporated by reference herein. Given $\alpha_{(j,N)},\beta_{(j,N)}$, the optimal $N_j$ is found as $$N_j = \underset{N\in[N_{min},N_{max}]}{\operatorname{argmin}} \sum_{m=Y_{start}}^{Y_{end}} (x_j[m] - \alpha_{(j,N)}x_j[m-N] - \beta_{(j,N)}x_j[m-N+1])^2$$

where $N_{min},N_{max}$ are the lower and upper boundaries of the period search range. In the above equations, the signal can be replaced with reconstructed samples $\hat{x}[m]$ for backward adaptive parameter estimation. The process above is now iterated over the component filters of the cascade, until convergence or until a desired level of performance is met. Convergence is guaranteed as the overall prediction error is monotonically non-increasing at every step of the iteration.

Finally, the number of filters (and equivalently the estimated number of periodic components) may be optimized by repeating the above optimization process while varying this number. The combination of CLTP parameters, namely the number of periodic components and all individual filter parameters, which minimizes the prediction error energy is the complete set of CLTP parameters, according to a preferred embodiment of the invention.

The CLTP embodiments described above may be adapted for compression of audio signals within the real world codecs of Bluetooth SBC and MPEG AAC or for frame loss concealment as described next.

CLTP for Compression of Audio Signals

As explained earlier, CLTP can be used to exploit redundancies in the periodic components of a polyphonic signal to achieve significant compression gains.

Figure 3:
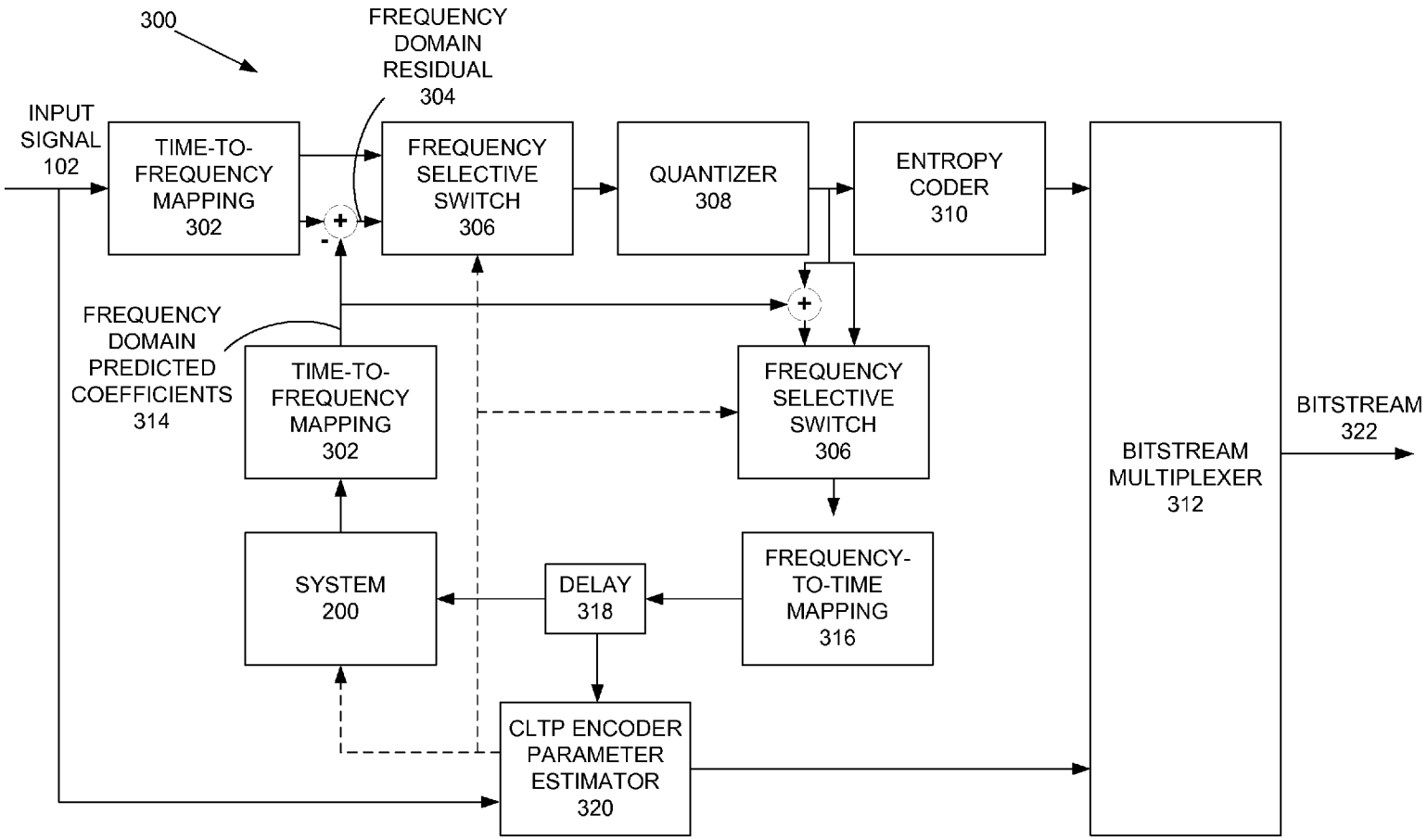
FIG. 3 illustrates an encoder of an audio compression system in accordance with one or more embodiments of the present invention.

FIG. 3 illustrates an encoder 300 of an audio compression system in accordance with one or more embodiments of the present invention. Input signal 102 is processed block-wise and mapped from time to frequency domain via transform 302 (or alternatively by an analysis filter bank) to generate frequency domain coefficients which, after subtraction of their predicted values 314, yield the frequency domain residual 304. Frequency selective switch 306 may then be used to select between the coefficients or the residual 304 for better prediction efficiency. The signal is then quantized with quantizer 308, encoded with entropy coder 310 and sent to bitstream multiplexer 312. The frequency domain predicted coefficients 314 are now selectively added to the quantized signal using the frequency selective switch 306, the output of which is then mapped back from frequency to time domain by the inverse transform 316 (or alternatively by a synthesis filter bank) to generate time domain reconstructed samples. These samples are buffered in delay 318, so that the previously reconstructed samples are available for encoding the current frame. The CLTP encoder parameter estimator 320 may use a combination of previously reconstructed samples from delay 318 and/or the input signal 102, to estimate parameters for the LTP filters used in system 200 and parameters of the frequency selective switch 306. Parameters which are estimated using the input signal 102 cannot be re-estimated at the decoder of an audio compression system and thus must be provided as side information, and are sent to the bitstream multiplexer 312. The system 200 predicts an entire block of audio signals by using the cascaded synthesis filter with the residual signal 110 set to zero and initial states 202-206 set such that output signal 208 for previous blocks matches the previously reconstructed samples. The output signal 208 generated for the current block is now mapped from time to frequency domain by transform 302 (or alternatively by a analysis filter bank) to generate the frequency domain predicted coefficients 314. The bitstream multiplexer 312 multiplexes all its inputs onto the bitstream 322 which is transmitted to the decoder of an audio compression system.

Figure 4:
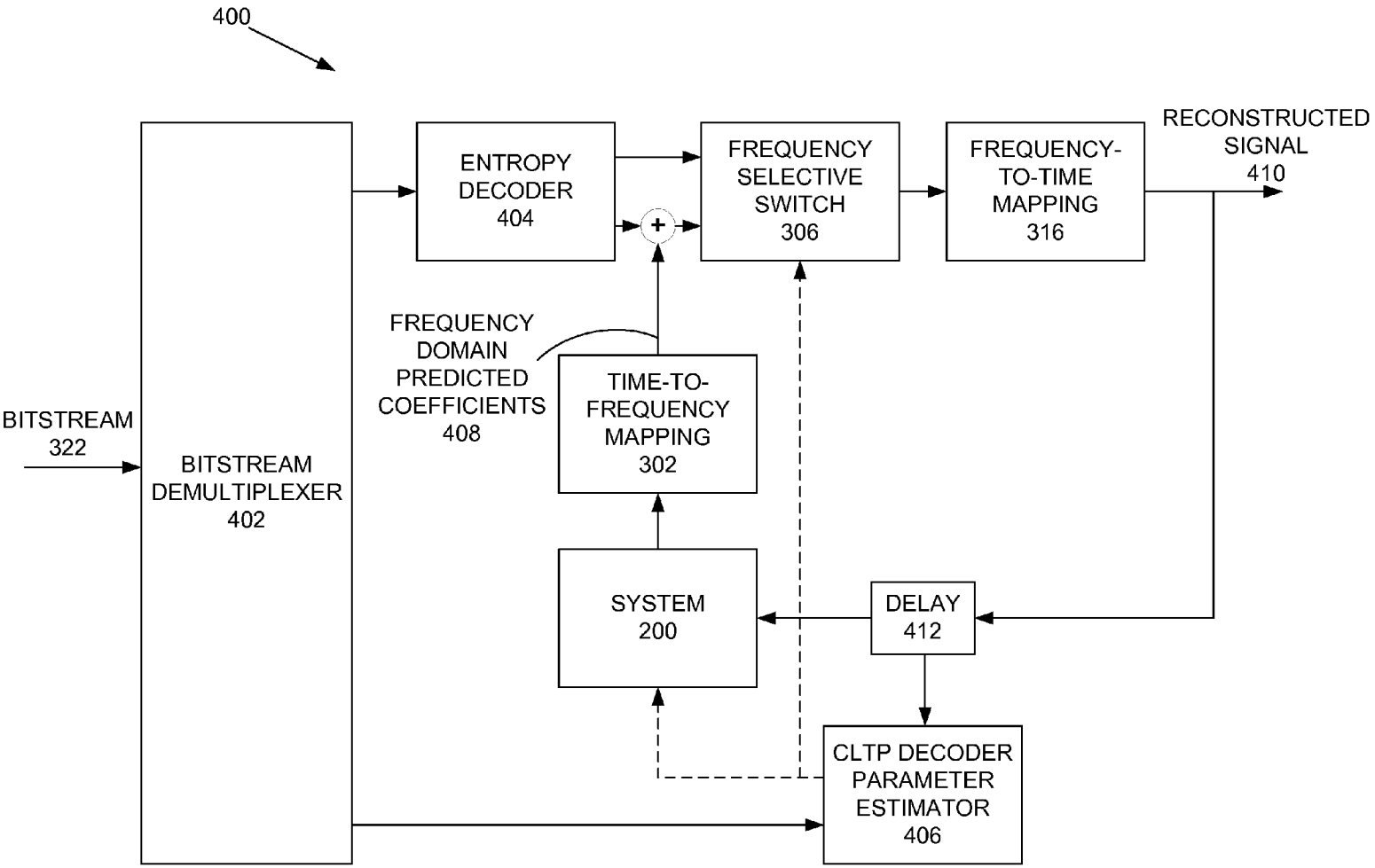
FIG. 4 illustrates a decoder of an audio compression system in accordance with one or more embodiments of the present invention.

FIG. 4 illustrates a decoder 400 of an audio compression system in accordance with one or more embodiments of the present invention. The bitstream 322 is processed through the bitstream demultiplexer 402 which separates information to be sent to the entropy decoder 404 (which subsumes a dequantizer) and to the CLTP decoder parameter estimator 406. The quantized signal is decoded using the entropy decoder 404. The frequency domain predicted coefficients 406 are then selectively added to the quantized signal using the frequency selective switch 306, the output of which is then mapped from frequency to time domain by the inverse transform 316 (or alternatively by a synthesis filter bank) to generate time domain reconstructed signal 410. This signal is buffered in delay 412, so that the previously reconstructed samples are available for decoding the current frame. The CLTP decoder parameter estimator 406 may use previously reconstructed samples from delay 412 to estimate parameters of the cascaded synthesis filters used in system 200 and parameters of the frequency selective switch 306. Alternatively the CLTP decoder parameter estimator 406 may receive all or part of these parameters from the bitstream, The system 200 predicts an entire block of audio signals by using the synthesis filter with the residual signal 110 set to zero and initial states 202-206 set such that output signal 208 for previous blocks matches the previously reconstructed samples. The output signal 208 generated for the current block is then mapped from time to frequency domain by transform 302 (or alternatively by a analysis filter bank) to generate the frequency domain predicted coefficients 412.

The above CLTP embodiments of encoder 300 and decoder 400 may represent the Bluetooth Subband Codec (SBC) system where the mapping from time to frequency domain 302 is implemented by an analysis filter bank, and inverse mapping from frequency to time domain 306 is implemented by a synthesis filterbank. The CLTP encoder parameter estimator 320 and the CLTP decoder parameter estimator 406 may operate only on previously reconstructed samples, i.e., backward adaptive prediction to minimize mean squared error as described in the provisional applications cross referenced above and incorporated by reference herein.

The above CLTP embodiments of encoder 300 and decoder 400 may represent the MPEG AAC system with transform to frequency domain 302 and inverse transform from frequency domain 306 implemented by MDCT and IMDCT, respectively. The CLTP encoder parameter estimator 320 and the CLTP decoder parameter estimator 406 may be designed such that most of the parameters are estimated from previously reconstructed samples, i.e., backward adaptively to minimize mean squared error, and the remaining parameters may be adjusted to the perceptual distortion criteria of the coder and sent as side information, as described in the provisional applications cross referenced above and incorporated by reference herein. The CLTP encoder parameter estimator 320 may alternatively be used with all of the parameters estimated forward adaptively and sent as part of the bitstream to the CLTP decoder parameter estimator 406, to achieve a low decoder complexity variant, as described in the provisional applications cross referenced above and incorporated by reference herein. The CLTP encoder parameter estimator 320 may be used with most of the parameters estimated forward adaptively and sent as part of bitstream to the CLTP decoder parameter estimator 406, while small subset of parameters is estimated backward adaptively in both CLTP encoder parameter estimator 320 and CLTP decoder parameter estimator 406 to obtain a moderate decoder complexity variant as described in the provisional applications cross referenced above and incorporated by reference herein. In both the low decoder complexity variant and the moderate decoder complexity variant the parameters may be initially estimated to minimize mean squared error and then adjusted to take perceptual distortion criteria of the coder into account.

Figure 5:
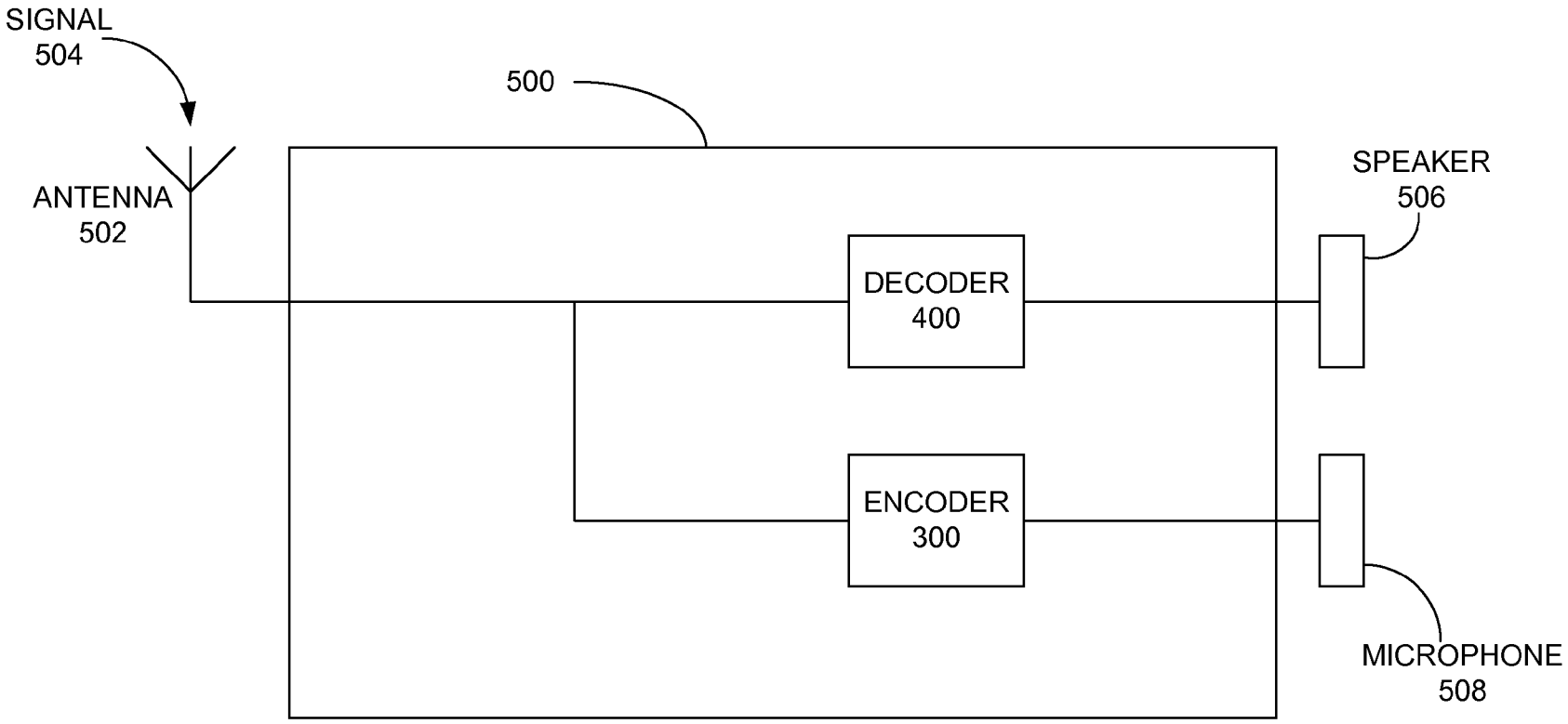
FIG. 5 illustrates an application using CLTP based compression in accordance with one or more embodiments of the present invention.

FIG. 5 illustrates an application in accordance with one or more embodiments of the present invention.

System 500 with antenna 502 is illustrated, where decoder 400 as described above is coupled to a speaker 506, and microphone 508 is coupled to encoder 300 as described above. System 500 can be, for example, a bluetooth transceiver or another wireless device, or a cellular telephone device, or another device for communication of audio or other signals 114.

Signal 504 received at antenna 502 is input into decoder 400, which is decoded and played back on speaker 506. Similarly, signal captured at microphone 508, is encoded with encoder 300 and sent to antenna 502 for transmission.

Frame Loss Concealment and Reverse Estimation

As explained earlier, Frame Loss Concealment (FLC) forms a crucial tool to mitigate unreliable networking conditions. In this regard, a frame may be lost, and it is desirable to replace/conceal the lost frame using various FLC techniques.

Figure 6:
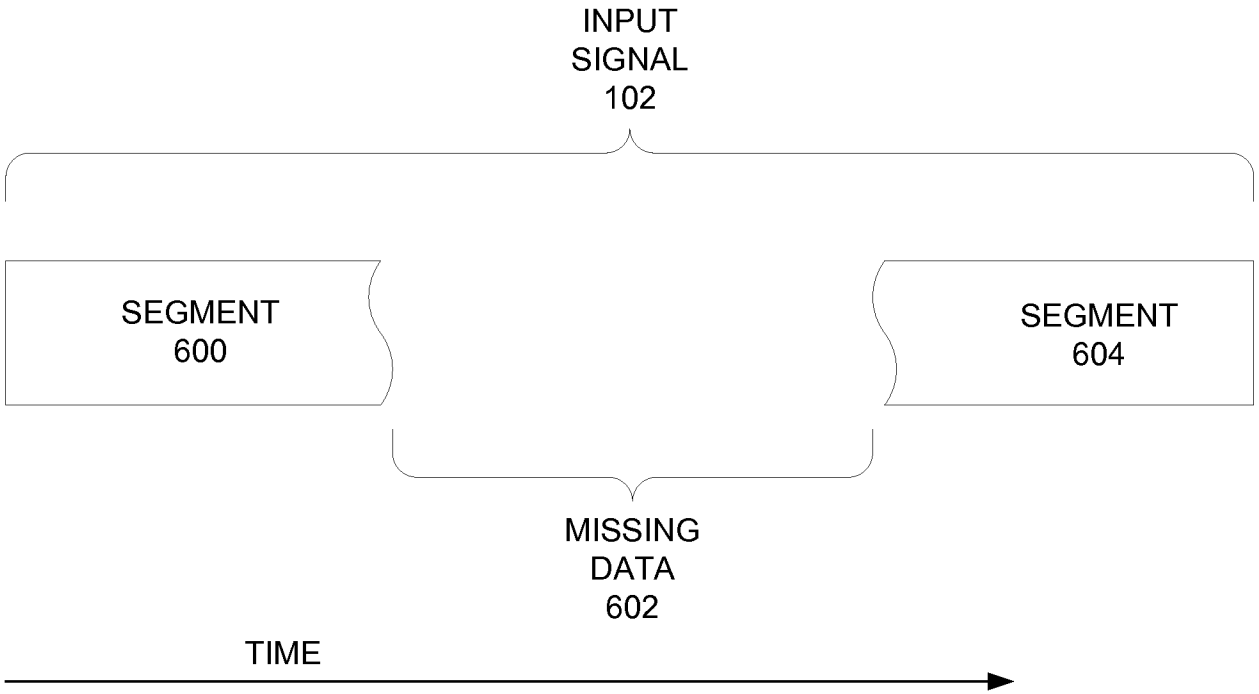
FIG. 6 illustrates a typical signal in accordance with one or more embodiments of the present invention.

FIG. 6 illustrates a typical signal in accordance with one or more embodiments of the present invention. Input signal 102 may comprise segment 600, missing data 602, and segment 604, where time increases as shown from left to right. As such, there may be a beginning segment 600, where signal 102 is easily received and no estimation of signal 102 is required. When signal 102 is somehow interrupted, however, missing data portion 602 of signal 102 must be estimated, or the resulting replay of signal 102 will be discontinuous. Embodiments of the present invention as described herein provide the ability and devices to estimate missing data 602, such that the resulting reconstruction of signal 102 can be a continuous signal reasonably approximating the original, or, at least, reduce the amount of missing data such that signal 102 can be continuous between segment 600 and segment 604.

The CLTP synthesis system 200 may be used to predict the block of missing data by using the cascaded synthesis filter with the residual signal 110 set to zero and initial states 202-206 set such that output signal 208 for previous blocks matches the previously reconstructed samples. Further, a preliminary set of parameters for these filters may be estimated from past segment 600 to minimize mean squared error via the recursive divide and conquer technique described above. The filter parameters may then be adjusted to minimize prediction error in the future segment 604 as described in the provisional applications cross referenced above and incorporated by reference herein.

However, there are also times when the continuity of signal 102 must match segment 604, e.g., at the interface between missing data 602 and segment 604. Such a continuity may have the benefit of segment 600 such that predictions that are "forward in time" (i.e., where portions of signal 102 prior in time to the predictions) are available, and there are also occasions when segment 600 is not available. Thus, the present invention must, and can, predict missing data 602 based only on segment 604, such that the predictions are for missing data 602 that occurred prior in time to segment 604. Such predictions are commonly referred to as "reverse" or "backward" predictions for missing data 602. Such predictions are also useful to harmonize the predictions between segment 600 and segment 604, such that missing data 602 is not predicted in a discontinuous or otherwise incompatible fashion, at the interfaces between missing data 602 portion of signal 102 and segments 600 and 604. Such bi-directional predictions are further described in the cross-referenced provisional applications which are incorporated by reference herein.

In other words, further improvement in concealment quality is achieved by using samples predicted in the reverse direction from the future samples. To use an approach similar to the one described above for prediction in the forward direction, a reversed set of reconstructed samples available to the FLC module, is defined as $\hat{x}_r[m]=\hat{x}[K-1-m]$. This set in the range $-M_p \le m < 0$ forms the new "past" reconstructed samples and the range $K \le m < K+M_p$ forms the new "future" reconstructed samples. Since pitch periods are assumed to be stationary close to the lost frame, one may begin with the same preliminary CLTP filter estimate (as described above) for the reverse direction and estimate a new set of multiplicative factors $G_i^r$ via parameter refinement, to form the reverse CLTP filter, $$H_c^r(z) = \prod_{i=0}^{P-1} (1 - G_i^r(\alpha_i z^{-N_i} + \beta_i z^{-N_i+1}))$$

Given this reverse CLTP filter, another set of samples of the lost frame is generated via the 'looped' prediction as $\tilde{x}_r[m]$, $0 \le m < K$. Finally, the overall lost frame $\tilde{x}_o[m]$, $0 \le m < K$ is generated as a weighted average of the two sets as, $$\tilde{x}_o[m]=\tilde{x}[m]g[m]+\tilde{x}_r[K-1-m](1-g[m])$$

where $g[m]=(1-m/(K-1))$ are the weights which are proportional to each predicted sample's distance from the set of reconstructed samples used for their generation.

Figure 7:
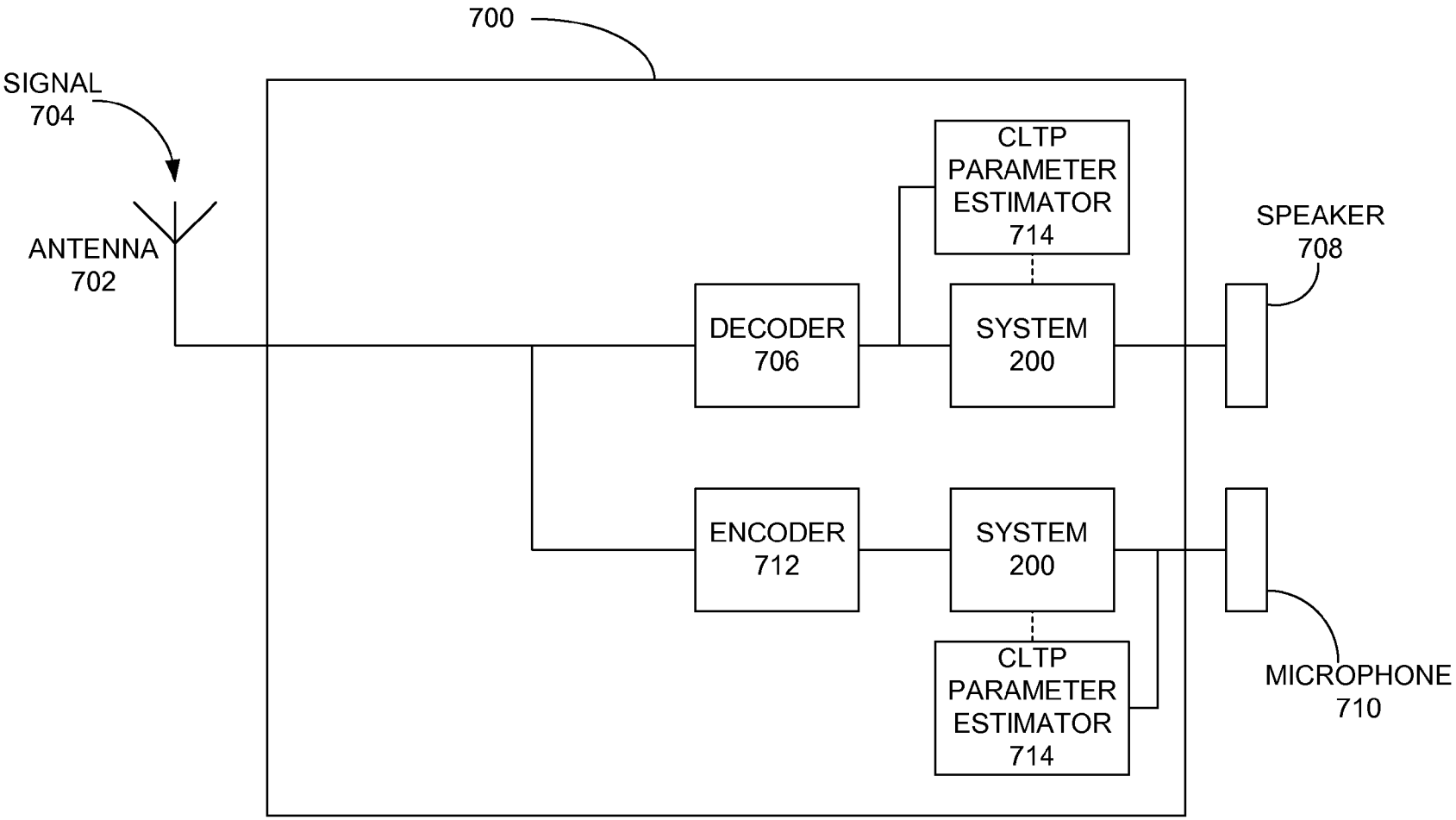
FIG. 7 illustrates an application using CLTP based frame loss concealment in accordance with one or more embodiments of the present invention.

FIG. 7 illustrates an application in accordance with one or more embodiments of the present invention.

System 700 with antenna 702 is illustrated, where decoder 706 is coupled to one system 200 which is coupled to speaker 708, and microphone 710 is coupled to another system 200 which is coupled to encoder 712. System 700 can be, for example, a bluetooth transceiver or another wireless device, or a cellular telephone device, or another device for communication of audio or other signals 704.

Signal 704 received at antenna 702 is input into decoder 706. When this input signal is somehow interrupted, e.g., because of interference or other reasons, system 200 along with the CLTP parameter estimator 714 can provide estimations for the lost signal as described above, which is output to speaker 708. Similarly, when there is an interruption of the input from microphone 710, the second system 200 along with second CLTP parameter estimator 714 can provide an estimate of the lost signal portion as described above to encoder 712, which then encodes that estimate.

Hardware Environment

Figure 8:
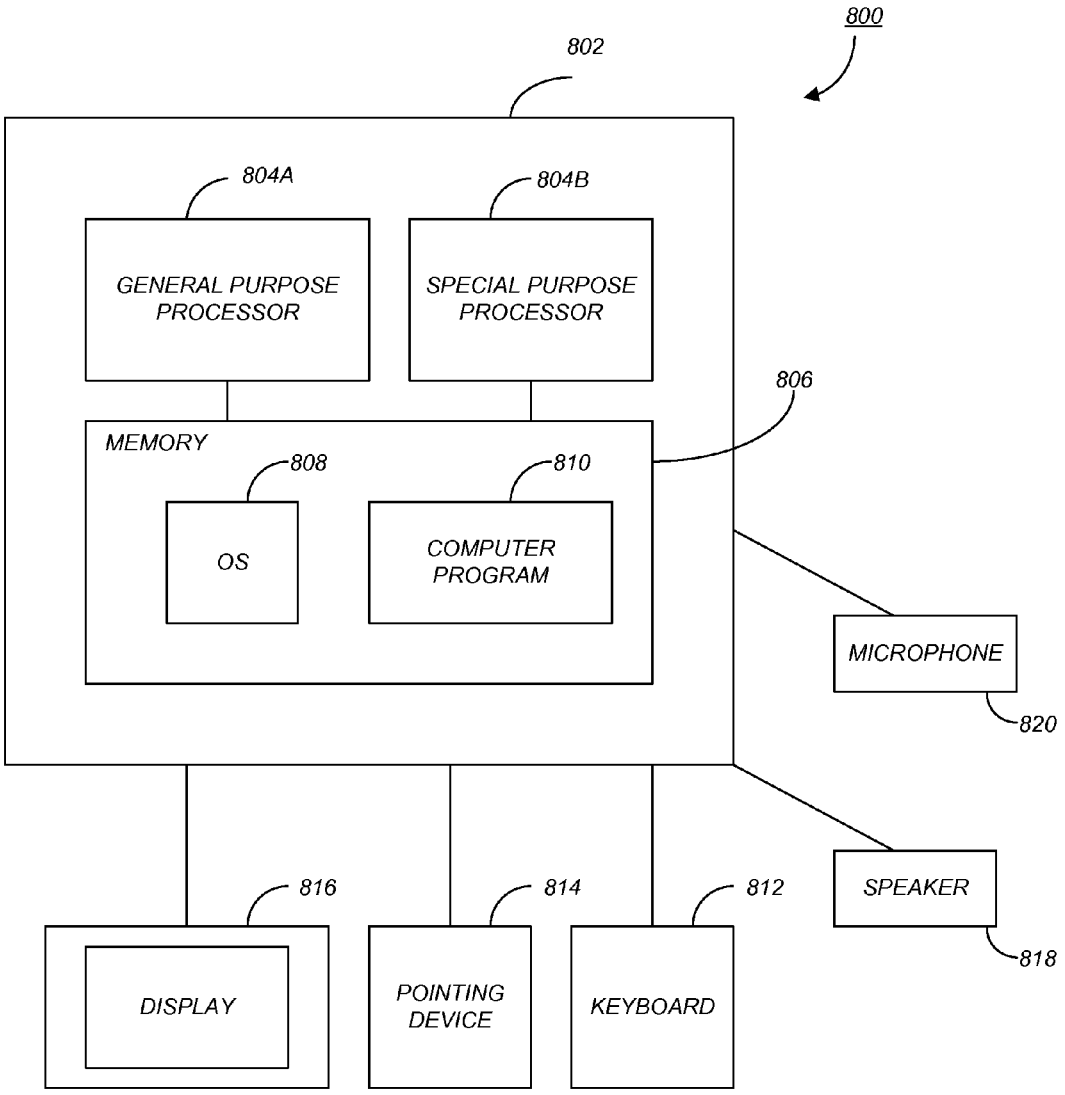
FIG. 8 is an exemplary hardware and software environment used to implement one or more embodiments of the invention.

FIG. 8 is an exemplary hardware and software environment 800 used to implement one or more embodiments of the invention. The hardware and software environment includes a computer 802 and may include peripherals. The computer 802 comprises a general purpose hardware processor 804A and/or a special purpose hardware processor 804B (hereinafter alternatively collectively referred to as processor 804) and a memory 806, such as random access memory (RAM). The computer 802 may be coupled to, and/or integrated with, other devices, including input/output (I/O) devices such as a keyboard 812 and a cursor control device 814 (e.g., a mouse, a pointing device, pen and tablet, touch screen, multi-touch device, etc.), a display 816, a speaker 818 (or multiple speakers or a headset) and a microphone 820. In yet another embodiment, the computer 802 may comprise a multi-touch device, mobile phone, gaming system, internet enabled television, television set top box, multimedia content delivery server, or other internet enabled device executing on various platforms and operating systems.

In one embodiment, the computer 802 operates by the general purpose processor 804A performing instructions defined by the computer program 810 under control of an operating system 808. The computer program 810 and/or the operating system 808 may be stored in the memory 806 and may interface with the user and/or other devices to accept input and commands and, based on such input and commands and the instructions defined by the computer program 810 and operating system 808, to provide output and results.

The CLTP and parameter estimation techniques may be performed within/by computer program 810 and/or may be executed by processors 804. Alternatively, or in addition, the CLTP filters may be part of computer 802 or accessed via computer 802.

Output/results may be played on speaker 818 or provided to another device for playback or further processing or action.

Some or all of the operations performed by the computer 802 according to the computer program 810 instructions may be implemented in a special purpose processor 804B. In this embodiment, the some or all of the computer program 810 instructions may be implemented via firmware instructions stored in a read only memory (ROM), a programmable read only memory (PROM) or flash memory within the special purpose processor 804B or in memory 806. The special purpose processor 804B may also be hardwired through circuit design to perform some or all of the operations to implement the present invention. Further, the special purpose processor 804B may be a hybrid processor, which includes dedicated circuitry for performing a subset of functions, and other circuits for performing more general functions such as responding to computer program 810 instructions. In one embodiment, the special purpose processor 804B is an application specific integrated circuit (ASIC).

Of course, those skilled in the art will recognize that any combination of the above components, or any number of different components, peripherals, and other devices, may be used with the computer 802.

Logical Flow

Figure 9:
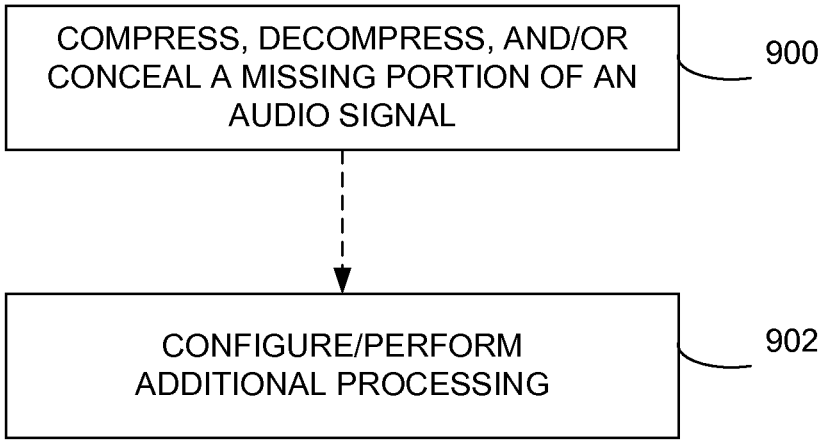
FIG. 9 illustrates the logical flow for processing an audio signal in accordance with one or more embodiments of the invention.

FIG. 9 illustrates the logical flow for processing an audio signal in accordance with one or more embodiments of the invention.

At step 900, an audio signal is compressed/decompressed and/or a missing portion of the audio signal (e.g., due to packet loss during transmission) is concealed (e.g., by estimating the missing portion). Step 900 is performed utilizing prediction by a plurality of cascaded long term prediction filters. Each of the plurality of cascaded long term prediction filters corresponds to one periodic component of the audio signal.

At step 902, further details regarding the compression/decompression/concealing processing of step 900 are configured and/or performed. Such processing/configuring may include multiple aspects as described in detail above. For example, one or more cascaded filter parameters of the cascaded long term prediction filters may be adapted to local audio signal characteristics. Such parameters may include a number of filters in a cascade, a time lag parameter, and a gain parameter (which may be sent to a decoder as side information) and/or estimated from a reconstructed audio signal. Such an adaptation may adjust cascaded filter parameters for each of the plurality of cascaded long term prediction filters, successively, while fixing all other cascaded filter parameters. The adapting/adjusting may then be iterated over all filters until a desired level of performance (e.g., a minimum prediction error energy) is met. The parameters (e.g., gain parameters) may be further adjusted to satisfy a perceptual criterion that may be obtained by calculating a noise to mask ratio.

The compression of the audio signal may include time-frequency mapping (e.g., employing a MDCT and/or an analysis filter bank), quantization, and entropy coding while the decompressing may include corresponding inverse operations of frequency-time mapping (e.g., employing an inverse MDCT and/or a synthesis filter bank), dequantization, and entropy decoding. The time-frequency mapping, quantization, entropy coding, and their inverse operations, may be utilized in an MPEG AAC scheme and/or utilized in a Bluetooth wireless system.

If concealing the missing portion of the audio signal, access to the audio signal may exist on both sides of the missing portion. Consequently, the concealing may include predicting the missing portion based on available audio samples on one side of the missing portion, and predicting the missing portion and available audio samples on the other side, wherein a prediction error is calculated for the available audio samples on the other side. Further, a first set of filters may be utilized to generate a first approximation of the missing portion from available past signal information. A second set of filters may also be utilized to operate in a reverse direction (having been optimized to predict a past from future audio samples), and generate a second approximation of the missing portion from available future signal information. A weighted average of the first and second approximations of the missing portion (e.g., using weights based/depending on a position of an approximated sample within the missing portion) may then be calculated.

REFERENCES

The following references are incorporated by reference herein to the description and specification of the present application.

[1] Information technology—Coding of audio-visual objects—Part 3: Audio—Subpart 4: General audio coding (GA), ISO/IEC Std. ISO/IEC JTC1/SC29 14 496-3:2005, 2005.

[2] Bluetooth Specification: Advanced Audio Distribution Profile, Bluetooth SIG Std. Bluetooth Audio Video Working Group, 2002.

[3] F. de Bont, M. Groenewegen, and W. Oomen, "A high quality audiocoding system at 128 kb/s," in Proc. 98th AES Convention, February 1995, paper 3937.

[4] E. Allamanche, R. Geiger, J. Herre, and T. Sporer, "MPEG-4 low delay audio coding based on the AAC codec," in Proc. 106th AES Convention, May 1999, paper 4929.

[5] J. Ojanper, M. Vaananen, and L. Yin, "Long term predictor for transform domain perceptual audio coding," in Proc. 107th AES Convention, September 1999, paper 5036.

[6] T. Nanjundaswamy, V. Melkote, E. Ravelli, and K. Rose, "Perceptual distortion-rate optimization of long term prediction in MPEG AAC," in Proc. 129th AES Convention, November 2010, paper 8288.

[9] B. S. Atal and M. R. Schroeder, "Predictive coding of speech signals," in Proc. Conf. Commun., Processing, November 1967, pp. 360-361.

[10] S. M. Kay, Modern Spectral Estimation. Englewood Cliffs, N.J.: Prentice-Hall, 1988.

[11] A. de Cheveigń e, "A mixed speech FO estimation algorithm," in Proceedings of the 2nd European Conference on Speech Communication and Technology (Eurospeech '91), September 1991.

[12] D. Giacobello, T. van Waterschoot, M. Christensen, S. Jensen, and M. Moonen, "High-order sparse linear predictors for audio processing," in Proc. 18th European Sig. Proc. Conf., August 2010, pp. 234-238.

[13] Information technology—Coding of moving pictures and associated audio for digital storage media at up to about 1.5 Mbit/s—Part 3: Audio, ISO/IEC Std. ISO/IEC JTC1/SC29 11 172-3, 1993.

[14] M. Bosi, K. Brandenburg, S. Quackenbush, L. Fielder, K. Akagiri, H. Fuchs, M. Dietz, J. Herre, G. Davidson, and Y. Oikawa, "ISO/IEC MPEG-2 advanced audio coding," J. Audio Eng. Soc., vol. 45, no. 10, pp. 789-814, October 1997.

[15] A. Aggarwal, S. L. Regunathan, and K. Rose, "Trellis-based optimization of MPEG-4 advanced audio coding," in Proc. IEEE Workshop on Speech Coding, 2000, pp. 142-144.

[16] "A trellis-based optimal parameter value selection for audio coding," IEEE Trans. Audio, Speech, and Lang. Process., vol. 14, no. 2, pp. 623-633, 2006.

[17] C. Bauer and M. Vinton, "Joint optimization of scale factors and Huffman codebooks for MPEG-4 AAC," in Proc. 6th IEEE Workshop. Multimedia Sig. Proc., September 2004.

[18] R. P. Ramachandran and P. Kabal, "Pitch prediction filters in speech coding," IEEE Trans. Acoust., Speech, Signal Process., vol. 37, no. 4, pp. 467-477, 1989.

[19] R. Pettigrew and V. Cuperman, "Backward pitch prediction for lowdelay speech coding," in Conf. Rec., IEEE Global Telecommunications Conf., November 1989, pp. 34.3.1-34.3.6.

[20] H. Chen, W. Wong, and C. Ko, "Comparison of pitch prediction and adaptation algorithms in forward and backward adaptive CELP systems," in Communications, Speech and Vision, IEE Proceedings I, vol. 140, no. 4, 1993, pp. 240-245.

[21] M. Yong and A. Gersho, "Efficient encoding of the long-term predictor in vector excitation coders," Advances in Speech Coding, pp. 329-338, Dordrecht, Holland: Kluwer, 1991.

[22] S. McClellan, J. Gibson, and B. Rutherford, "Efficient pitch filter encoding for variable rate speech processing," IEEE Trans. Speech Audio Process., vol. 7, no. 1, pp. 18-29, 1999.

[23] J. Marques, I. Trancoso, J. Tribolet, and L. Almeida, "Improved pitch prediction with fractional delays in CELP coding," in Proc. IEEE Intl. Conf. Acoustics, Speech, and Sig. Proc., 1990, pp. 665-668.

[24] D. Veeneman and B. Mazor, "Efficient multi-tap pitch prediction for stochastic coding," Kluwer international series in engineering and computer science, pp. 225-225, 1993.

[25] P. Kroon and K. Swaminathan, "A high-quality multirate real-time CELP coder," IEEE J. Sel. Areas Commun., vol. 10, no. 5, pp. 850-857, 1992.

[26] J. Chen, "Toll-quality 16 kb/s CELP speech coding with very low complexity," in Proc. IEEE Intl. Conf. Acoustics, Speech, and Sig. Proc., 1995, pp. 9-12.

[27] W. Kleijn and K. Paliwal, Speech coding and synthesis. Elsevier Science Inc., 1995, pp. 95-102.

[28] Method of Subjective Assessment of Intermediate Quality Level of Coding Systems, ITU Std. ITU-R Recommendation, BS 1534-1, 2001.

[29] R. P. Ramachandran and P. Kabal, "Stability and performance analysis of pitch filters in speech coders," IEEE Trans. Acoust., Speech, Signal Process., vol. 35, no. 7, pp. 937-946, 1987.

[30] A. Said, "Introduction to arithmetic coding-theory and practice," Hewlett Packard Laboratories Report, 2004.

[31] C. Perkins, O. Hodson, and V. Hardman, "A survey of packet loss recovery techniques for streaming audio," *IEEE Network*, vol. 12, no. 5, pp. 40-48, 1998.

[32] S. J. Godsill and P. J. W. Rayner, *Digital audio restoration: a statistical model based approach*, Springer Verlag, 1998.

[33] J. Herre and E. Eberlein, "Evaluation of concealment techniques for compressed digital audio," in *Proc. 94th Conv. Aud. Eng. Soc*, February 1993, Paper 3460.

[34] R. Sperschneider and P. Lauber, "Error concealment for compressed digital audio," in *Proc. 111th Conv. Aud. Eng. Soc*, November 2003, Paper 5460.

[35] S. U. Ryu and K. Rose, "An mdct domain frame-loss concealment technique for mpeg advanced audio coding," in *IEEE ICASSP*, 2007, pp. I-273-I-276.

[37] J. Nocedal, "Updating quasi-newton matrices with limited storage," *Mathematics of computation*, vol. 35, no. 151, pp. 773-782, 1980.

[38] J. Nocedal and S. J. Wright, *Numerical optimization*, Springer Verlag, 1999.

CONCLUSION

In conclusion, embodiments of the present invention provide an efficient and effective solution to the problem of predicting polyphonic signals. The solution involves a framework of a cascade of LTP filters, which by design is tailored to account for all periodic components present in a polyphonic signal. Embodiments of the invention complement this framework with a design method to optimize the system parameters. Embodiments also specialize to specific techniques for coding and networking scenarios, where the potential of each enhanced prediction considerably improves the overall system performance for that application. The effectiveness of such an approach has been demonstrated for various commercially used systems and standards, such as the Bluetooth audio standard for low delay short range wireless communications (e.g., SNR improvements of about 5 dB), and the MPEG AAC perceptual audio coding standard.

Accordingly, embodiments of the invention enable performance improvement in various audio related applications, including for example, music storage and distribution (e.g., Apple™ iTunes™ store), as well as high efficiency storage and playback devices, wireless audio streaming (especially to mobile devices), and high-definition teleconferencing (including on smart phones and tablets). Embodiments of the invention may also be utilized in areas/products that involve mixed speech and music signals as well as in unified speech-audio coding. Further embodiments may also be utilized in multimedia applications that utilize cloud based content distribution services.

In addition to the above, embodiments of the invention provide an effective means to conceal the damage due to lost samples, and specifically overcomes the main challenge due to the polyphonic nature of music signals by employing a cascade of long term prediction filters (tailored to each periodic component) so as to effectively estimate all periodic components in the time-domain while fully utilizing all of the available information. Methods of the invention are capable of exploiting available information from both sides of the missing frame or lost samples to optimize the filter parameters and perform uni or bi-directional prediction of the lost samples. Embodiments of the invention also guarantee that the concealed lost frame is embedded seamlessly within the available signal. The effectiveness of such concealing has been demonstrated and has provided improved quality over existing FLC techniques. For example, gains of 20-30 points (on a scale of 0 to 100) in a standard subjective qualify measure of MUSHRA (Multiple Stimuli with Hidden Reference and Anchor) and Segmental SNR improvements of about 7 dB have been obtained.

In view of the above, embodiments of the present invention disclose methods and devices for signal estimation/prediction.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the invention and the following claims, and the full range of equivalents of the claims.

This concludes the description of the preferred embodiment of the present invention. The foregoing description of one or more embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto and the full range of equivalents of the claims. The attached claims are presented merely as one aspect of the present invention. The Applicant does not disclaim any claim scope of the present invention through the inclusion of this or any other claim language that is presented or may be presented in the future. Any disclaimers, expressed or implied, made during prosecution of the present application regarding these or other changes are hereby rescinded for at least the reason of recapturing any potential disclaimed claim scope affected by these changes during prosecution of this and any related applications. Applicant reserves the right to file broader claims in one or more continuation or divisional applications in accordance within the full breadth of disclosure, and the full range of doctrine of equivalents of the disclosure, as recited in the original specification.

What is claimed is:

1. A method for processing an audio signal, comprising:

processing an audio signal in a codec, wherein:

the codec comprises an encoder, a decoder, or both an encoder and a decoder;

the encoder processes the audio signal to generate encoded data and the decoder processes the encoded data to reconstruct the audio signal;

the processing of the audio signal in the codec comprises processing the audio signal utilizing prediction performed by a plurality of cascaded long term prediction filters in the codec, wherein each of the plurality of cascaded long term prediction filters corresponds to one periodic component of the audio signal.

2. The method of claim 1, further comprising adapting one or more cascaded filter parameters of the cascaded long term prediction filters to local audio signal characteristics, wherein the one or more cascaded filter parameters comprise a number of filters in a cascade, a time lag parameter, and a gain parameter.

3. The method of claim 2, wherein one or more of the cascaded filter parameters are sent to a decoder as side information.

4. The method of claim 2, wherein one or more of the cascaded filter parameters are estimated from a reconstructed audio signal.

5. The method of claim 2, wherein:

adapting the cascaded filter parameters comprises adjusting one or more of the one or more cascaded filter parameters for each of the plurality of cascaded long term prediction filters, successively, while fixing all other cascaded filter parameters; and iterating over all cascaded long term prediction filters until a desired level of performance is met.

6. The method of claim 5, wherein the desired level of performance corresponds to a minimum prediction error energy.

7. The method of claim 6, wherein one or more cascaded filter parameters are further adjusted to satisfy a perceptual criterion.

8. The method of claim 7, wherein the one or more cascaded filter parameters that are adjusted to satisfy the perceptual criterion are gain parameters.

9. The method of claim 7, wherein the perceptual criterion is obtained by calculating a noise to mask ratio.

10. The method of claim 1, wherein:

the processing of the audio signal in the encoder further comprises time-frequency mapping, quantization, and entropy coding; and the processing of the audio signal in the decoder further comprises corresponding inverse operations of frequency-time mapping, dequantization, and entropy decoding.

11. The method of claim 10, wherein time-frequency mapping employs a modified discrete cosine transform (MDCT) and frequency-time mapping employs an inverse MDCT.

12. The method of claim 10, wherein time-frequency mapping employs an analysis filter bank, and frequency-time mapping employs a synthesis filter bank.

13. The method of claim 10, wherein time-frequency mapping, quantization, entropy coding, and their inverse operations, are based on Moving Pictures Experts Group (MPEG) Advanced Audio Coding (AAC).

14. The method of claim 10, wherein time-frequency mapping, quantization, entropy coding, and their inverse operations, are based on a Bluetooth Subband Codec.

15. A device for processing an audio signal, comprising:

a codec for processing an audio signal, wherein:

the codec comprises an encoder, a decoder, or both an encoder and a decoder;

the encoder processes the audio signal to generate encoded data and the decoder processes the encoded data to reconstruct the audio signal; and the processing of the audio signal in the codec comprises processing the audio signal utilizing prediction performed by a plurality of cascaded long term prediction filters in the codec, wherein each of the plurality of cascaded long term prediction filters corresponds to one periodic component of the audio signal.

16. The device of claim 15, wherein the device is further configured to adapt one or more cascaded filter parameters of the cascaded long term prediction filters to local audio signal characteristics, wherein the one or more cascaded filter parameters comprise a number of filters in a cascade, a time lag parameter, and a gain parameter.

17. The device of claim 16, wherein the device adapts the cascaded filter parameters by:

adjusting one or more of the one or more cascaded filter parameters for each of the plurality of cascaded long term prediction filters, successively, while fixing all other cascaded filter parameters; and iterating over all cascaded long term prediction filters until a desired level of performance is met.

* * * * *